US007300362B1

(12) United States Patent
Umezawa et al.

(10) Patent No.: US 7,300,362 B1
(45) Date of Patent: Nov. 27, 2007

(54) GOLF BALL

(75) Inventors: Junji Umezawa, Chichibu (JP); Hiroyuki Nagasawa, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 11/595,893

(22) Filed: Nov. 13, 2006

(51) Int. Cl.
*A63B 37/06* (2006.01)

(52) U.S. Cl. ..... 473/374

(58) Field of Classification Search ..... None
See application file for complete search history.

(56) References Cited

U.S. PATENT DOCUMENTS

| | | | | |
|---|---|---|---|---|
| 5,553,852 | A | 9/1996 | Higuchi et al. | |
| 6,106,415 | A * | 8/2000 | Masutani et al. | 473/374 |
| 6,129,640 | A * | 10/2000 | Higuchi et al. | 473/374 |
| 6,194,505 | B1 | 2/2001 | Sone et al. | |
| 6,277,036 | B1 * | 8/2001 | Hayashi et al. | 473/376 |
| 6,592,470 | B2 | 7/2003 | Watanabe et al. | |
| 6,642,314 | B2 | 11/2003 | Sone et al. | |
| 6,656,059 | B2 | 12/2003 | Umezawa et al. | |
| 6,663,507 | B1 | 12/2003 | Watanabe et al. | |
| 6,679,791 | B2 | 1/2004 | Watanabe et al. | |
| 6,814,676 | B2 | 11/2004 | Watanabe et al. | |
| 7,140,979 | B2 | 11/2006 | Umezawa et al. | |
| 7,140,980 | B2 | 11/2006 | Umezawa et al. | |
| 2002/0019271 | A1 * | 2/2002 | Maruko et al. | 473/371 |
| 2004/0147694 | A1 | 7/2004 | Sone et al. | |
| 2007/0155541 | A1 * | 7/2007 | Watanabe et al. | 473/371 |

FOREIGN PATENT DOCUMENTS

| | | | |
|---|---|---|---|
| JP | 7-024085 | A | 1/1995 |
| JP | 11-035633 | A | 2/1999 |
| JP | 11-164912 | A | 6/1999 |
| JP | 2002-000765 | A | 1/2002 |
| JP | 2002-293996 | A | 10/2002 |
| JP | 2002-315848 | A | 10/2002 |
| JP | 2002-345999 | A | 12/2002 |
| JP | 2003-190330 | A | 7/2003 |
| JP | 2004-049913 | A | 2/2004 |
| JP | 2005-224514 | A | 8/2005 |
| JP | 2005-224515 | A | 8/2005 |

* cited by examiner

*Primary Examiner*—Raeann Trimiew
(74) *Attorney, Agent, or Firm*—Sughrue Mion, PLLC

(57) ABSTRACT

The invention provides a golf ball having a solid core, an intermediate layer encasing the core, and an outermost layer cover of urethane which is softer than the intermediate layer. The outermost layer cover has a surface hardness, expressed in JIS-C hardness units, of at least 76 but not more than 88, and a thickness of at least 0.6 mm but not more than 1.0 mm. Letting A be the deflection of a sphere composed of the core encased by the intermediate layer when compressed under a final load of 1,275 N (130 kg) from an initial load state of 98 N (10 kgf) and B be the deflection of the core when compressed under a final load of 1,275 N (130 kg) from an initial load state of 98 N (10 kgf), the value A/B is at least 0.74 but not more than 0.82. The value expressed as (JIS-C surface hardness of intermediate layer×intermediate layer thickness)−(JIS-C surface hardness of cover×cover thickness) is at least 90 but not more than 120. The golf ball of the invention has a substantially increased travel distance, and can be imparted with a very good spin controllability. Moreover, it also has an excellent durability to cracking under repeated impact and an excellent scuff resistance.

4 Claims, No Drawings

GOLF BALL

BACKGROUND OF THE INVENTION

The present invention relates to a multi-piece golf ball having at least a core, an intermediate layer and an outermost layer cover, and relates in particular to a golf ball ideal for professional golfers and skilled amateurs.

Golf balls with a three-piece construction that are hard on the interior and soft at the exterior have been proposed as solid golf balls to address the desires of professional golfers and skilled amateurs. One example is the golf ball having a hard interior and a soft exterior disclosed in JP-A 7-24085. However, because this golf ball uses a cover made of a hard ionomer resin and the cover is relatively thick, it has a poor balance between the distance traveled when hit with a driver (W#1) and the spin when played with a sand wedge (SW), in addition to which it has a poor scuff resistance.

Examples of golf balls having further improved spin, flight performance and durability relative to the foregoing golf ball include the golf balls disclosed in JP-A 2002-765, JP-A 2002-315848 and JP-A 2003-190330. However, these golf balls have a poor travel distance when played with a driver. Moreover, the golf ball disclosed in JP-A 2002-765 also has a poor scuff resistance.

Additional examples include the golf balls described in JP-A 2004-049913, JP-A 2002-345999, JP-A 2005-224514 and JP-A 2005-224515. Unfortunately, these golf balls lack a good balance between flight when hit with a driver (W#1) and spin control when played with a sand wedge (SW).

Thus, in the various golf balls which have been disclosed to date, improvements in flight and spin control still leave something to be desired. Hence, there exists a desire for a golf ball which achieves a good balance of flight and spin control and also has an improved durability.

SUMMARY OF THE INVENTION

It is thus an object of the present invention to provide a golf ball for use by professional golfers and skilled amateurs which has a further improved flight and controllability and also has an excellent durability to cracking under repeated impact and an excellent scuff resistance.

As a result of extensive investigations, the inventors have found that, in a golf ball having a solid core encased within an intermediate layer and, as the outermost layer, a urethane cover which is softer than the intermediate layer, by setting the JIS-C hardness at the surface of the outermost layer cover and the thickness of the outermost layer cover within specific ranges, by optimizing the ratio between the deflection of two spheres—one being the sphere composed of the core encased by the intermediate layer and the other being the core—when each of the two spheres is subjected to a specific load and, concerning the relationship between the intermediate layer and the cover, by determining their respective surface hardness×thickness values and optimizing the difference therebetween, it is possible to improve the flight of the golf ball and substantially enhance its controllability, and also to impart the golf ball with an excellent durability to cracking under repeated impact and an excellent scuff resistance, thus achieving a golf ball capable of manifesting a performance that is ideal for the professional golfer and the skilled amateur.

That is, in the present invention, (1) by having the basic construction be a multi-piece construction with a solid core, an outermost layer cover, and an intermediate layer disposed therebetween, (2) by forming the outermost layer cover primarily of a polyurethane such as a thermoplastic polyurethane elastomer, which is effective for imparting controllability that enables use even by professional golfers and skilled amateurs and for improving scuff resistance, (3) by giving the outermost layer cover a surface hardness, expressed in JIS-C hardness units, of at least 76 but not more than 88 and a thickness of at least 0.6 mm but not more than 1.0 mm; that is, by achieving a cover having a certain degree of softness and thinness, (4) by having the value A/B, where A is the deflection of the sphere composed of the core encased by the intermediate layer when compressed under a final load of 1,275 N (130 kg) from an initial load state of 98 N (10 kgf) and B is the deflection of the core when compressed under a final load of 1,275 N (130 kg) from an initial load state of 98 N,(10 kgf), be at least 0.74 but not more than 0.82—that is, by imparting to the intermediate layer a certain degree of hardness and thickness, and (5) by having the (JIS-C surface hardness of intermediate layer×intermediate layer thickness)−(JIS-C surface hardness of cover×cover thickness) value be at least 90 but not more than 120—that is, by having the intermediate layer/cover construction hard on the inside and soft on the outside (here, "making the intermediate layer thicker" is close in meaning to "making the intermediate layer harder"), when the golf ball is struck at a high head speed, such as when played by a professional golfer or a skilled amateur, the ball travels a substantially longer distance and can be imparted with a very good spin controllability, in addition to which it has an excellent durability to cracking with repeated impact and an excellent scuff resistance.

Accordingly, the invention provides the following golf balls.

[1] A golf ball comprising a solid core, an intermediate layer encasing the core, and an outermost layer cover of urethane which is softer than the intermediate layer, wherein the outermost layer cover has a surface hardness, expressed in JIS-C hardness units, of at least 76 but not more than 88 and a thickness of at least 0.6 mm but not more than 1.0 mm; letting A be the deflection of a sphere composed of the core encased by the intermediate layer when compressed under a final load of 1,275 N (130 kg) from an initial load state of 98 N (10 kgf) and B be the deflection of the core when compressed under a final load of 1,275 N (130 kg) from an initial load state of 98 N (10 kgf), the value A/B is at least 0.74 but not more than 0.82, and the value expressed as (JIS-C surface hardness of intermediate layer×intermediate layer thickness)−(JIS-C surface hardness of cover×cover thickness) is at least 90 but not more than 120.

[2] The golf ball of [1] above, wherein the solid core has a diameter of from 36.3 to 37.9 mm, the core has a deflection B when compressed under a final load of 1,275 N (130 kg) from an initial load state of 98 N (10 kgf) of from 3.0 to 3.8 mm, and the hardness difference between the surface and the center of the core, expressed in JIS-C hardness units, is more than 20.

[3] The golf ball of [1], wherein the outermost layer cover is formed by injection molding a single resin blend composed primarily of (A) a thermoplastic polyurethane and (B) a polyisocyanate compound, which resin blend contains a polyisocyanate compound in at least a portion of which all the isocyanate groups on the molecule remain in an unreacted state.

[4] The golf ball of [3], wherein the resin blend additionally includes (C) a thermoplastic elastomer other than a thermoplastic polyurethane.

DETAILED DESCRIPTION OF THE INVENTION

The golf ball of the invention has a core and a cover of one or more layer which encases the core. In the specification, for the purpose of convenience, the cover which directly encloses the core is called the "intermediate layer" and the cover which encloses the intermediate layer and is positioned on the ball surface side is called the "outermost layer cover." The above-described core, the above-described intermediate layer and the above-described outermost layer cover are essential components of the inventive golf ball. The ball performance is enhanced by the interaction between these layers. Details of these layers are given below.

Details concerning the core, the intermediate layer and the outermost layer cover which may be used in the invention are provided below for the respective components of the ball.

The core has a diameter of preferably at least 35.0 mm, and more preferably at least 36.3 mm, but not more than 37.9 mm. If the core diameter is too small, the cover becomes relatively thick, as a result of which a sufficient resilience may not be achieved. On the other hand, if the core diameter is too large, a spin rate-lowering effect due to the hard intermediate layer may not be achieved.

The core has a deflection, when compressed under a final load of 1,275 N (130 kg) from an initial load state of 98 N (10 kgf), of at least 2.8 mm but not more than 4.0 mm, preferably at least 3.0 mm but not more than 3.8 mm, and more preferably at least 3.2 mm but not more than 3.7 mm. At a core hardness greater than the above range, the feel of the ball on impact worsens and, particularly on long shots such as with a driver in which the ball incurs a large deformation, the spin rate of the ball may increase excessively, reducing the carry of the ball. On the other hand, if the core is too soft, the ball tends to have a dead feel when hit and a less than satisfactory rebound, which may result in a poor distance. Moreover, the durability of the ball to cracking on repeated impact may also worsen.

The core has a surface hardness, expressed in JIS-C hardness units, of at least 75 but not more than 98, preferably at least 80 but not more than 95, and more preferably at least 83 but not more than 92. The core has a center hardness, expressed in JIS-C hardness units, of at least 54 but not more than 68, preferably at least 56 but not more than 66, and more preferably at least 58 but not more than 64.

The difference in the two above hardnesses, that is the value obtained by subtracting the core center hardness from the core surface hardness, expressed in JIS-C hardness units, is preferably at least 15 but not than 36, more preferably at least 18 but not more than 32, and even more preferably at least 20 but not more than 30. By setting the hardness difference in this range, the spin rate of the ball on full shots can be reduced. That is, if this difference is too small, the spin rate lowering effect on shots taken with a W#1 is small, which may shorten the distance traveled by the ball.

The solid core having the above-described surface hardness and deflection may be composed primarily of a rubber material. For example, the core may be made of a rubber composition containing, in addition to the rubber component, a co-crosslinking agent, an organic peroxide, an inert filler, an organosulfur compound and the like. It is preferable to use polybutadiene as the base rubber of this rubber composition.

It is desirable for the polybutadiene serving as the rubber component to have a cis-1,4-bond content on the polymer chain of at least 60 wt %, preferably at least 80 wt %, more preferably at least 90 wt %, and most preferably at least 95 wt %. Too low a cis-1,4-bond content among the bonds on the molecule may lead to a lower resilience.

Moreover, the polybutadiene has a 1,2-vinyl bond content on the polymer chain of preferably not more than 2%, more preferably not more than 1.7%, and even more preferably not more than 1.5%. Too high a 1,2-vinyl bond content may lead to a lower resilience.

To obtain a molded and vulcanized rubber composition of good resilience, the polybutadiene used in the invention is preferably one synthesized with a rare-earth catalyst or a Group VIII metal compound catalyst. Polybutadiene synthesized with a rare-earth catalyst is especially preferred.

Such rare-earth catalysts are not subject to any particular limitation. Exemplary rare-earth catalysts include those made up of a combination of a lanthamide series rare-earth compound with an organoaluminum compound, an alumoxane, a halogen-bearing compound and an optional Lewis base.

Examples of suitable lanthamide series rare-earth compounds include halides, carboxylates, alcoholates, thioalcoholates and amides of atomic number 57 to 71 metals.

In the practice of the invention, the use of a neodymium catalyst in which a neodymium compound serves as the lanthamide series rare-earth compound is particularly advantageous because it enables a polybutadiene rubber having a high cis-1,4 bond content and a low 1,2-vinyl bond content to be obtained at an excellent polymerization activity. Suitable examples of such rare-earth catalysts include those mentioned in JP-A 11-35633, JP-A 11-164912 and JP-A 2002-293996.

To enhance the resilience, it is preferable for the polybutadiene synthesized using the lanthamide series rare-earth compound catalyst to account for at least 10 wt %, preferably at least 20 wt %, and more preferably at least 40 wt %, of the rubber components.

Rubber components other than the above-described polybutadiene may be included in the base rubber insofar as the objects of the invention are attainable. Illustrative examples of suitable rubber components other than the above-described polybutadiene include other polybutadienes, and other diene rubbers, such as styrene-butadiene rubber, natural rubber, isoprene rubber and ethylene-propylene-diene rubber.

Examples of co-crosslinking agents include unsaturated carboxylic acids and the metal salts of unsaturated carboxylic acids.

Specific examples of unsaturated carboxylic acids include acrylic acid, methacrylic acid,maleic acid and fumaric acid. Acrylic acid and methacrylic acid are especially preferred.

The metal salts of unsaturated carboxylic acids, while not subject to any particular limitation, are exemplified by the above-mentioned unsaturated carboxylic acids neutralized with a desired metal ion. Specific examples include the zinc and magnesium salts of methacrylic acid and acrylic acid. The use of zinc acrylate is especially preferred.

The unsaturated carboxylic acid and/or metal salt thereof is included in an amount, per 100 parts by weight of the base rubber, of generally at least 10 parts by weight, preferably at least 15 parts by weight, and more preferably at least 20 parts by weight, but generally not more than 60 parts by weight, preferably not more than 50 parts by weight, more preferably not more than 45 parts by weight, and most preferably not more than 40 parts by weight. Too much may make the core too hard, giving the ball an unpleasant feel on impact, whereas too little may lower the rebound.

The organic peroxide may be a commercially available product, suitable examples of which include Percumyl D (produced by NOF Corporation), Perhexa 3M (NOF Corporation), and Luperco 231XL (Atochem Co.). These may be used singly or as a combination of two or more thereof.

The amount of organic peroxide included per 100 parts by weight of the base rubber is preferably at least 0.1 part by weight, more preferably at least 0.3 part by weight, even more preferably at least 0.5 part by weight, and most preferably at least 0.7 part by weight, but preferably not more than 5 parts by weight, more preferably not more than 4 parts by weight, even more preferably not more than 3 parts by weight, and most preferably not more than 2 parts by weight. Too much or too little organic peroxide may make it impossible to achieve a ball having a good feel on impact, good durability and a good rebound.

Examples of suitable inert fillers include zinc oxide, barium sulfate and calcium carbonate. These may be used singly or as a combination of two or more thereof.

The amount of inert filler included per 100 parts by weight of the base rubber is preferably at least 1 part by weight, and more preferably at least 5 parts by weight, but preferably not more than 50 parts by weight, more preferably not more than 40 parts by weight, and even more preferably not more than 30 parts by weight. Too much or too little inert filler may make it impossible to achieve a proper weight and a good rebound.

In addition, an antioxidant may be included if necessary. Illustrative examples of suitable commercial antioxidants include Nocrac NS-6, Nocrac NS-30 (both available from Ouchi Shinko Chemical Industry Co., Ltd.), and Yoshinox 425 (available from Yoshitomi Pharmaceutical Industries, Ltd.). These may be used singly or as a combination of two or more thereof.

The amount of antioxidant included per 100 parts by weight of the base rubber is preferably 0 or more part by weight, more preferably at least 0.05 part by weight, and even more preferably at least 0.1 part by weight, but preferably not more than 3 parts by weight, more preferably not more than 2 parts by weight, even more preferably not more than 1 part by weight, and most preferably not more than 0.5 part by weight. Too much or too little antioxidant may make it impossible to achieve a good rebound and a good durability.

To enhance the rebound of the golf ball and increase its initial velocity, it is preferable to include within the core an organosulfur compound.

No particular limitation is imposed on the organosulfur compound, provided it improves the rebound of the golf ball. Exemplary organosulfur compounds include thiophenols, thionaphthols, halogenated thiophenols, and metal salts thereof. Specific examples include pentachlorothiophenol, pentafluorothiophenol, pentabromothiophenol, p-chlorothiophenol, the zinc salt of pentachlorothiophenol, the zinc salt of pentafluorothiophenol, the zinc salt of pentabromothiophenol, the zinc salt of p-chlorothiophenol; and diphenylpolysulfides, dibenzylpolysulfides, dibenzoylpolysulfides, dibenzothiazoylpolysulfides and dithiobenzoylpolysulf ides having 2 to 4 sulfurs. Diphenyldisulfide and the zinc salt of pentachlorothiophenol are especially preferred.

It is recommended that the amount of the organosulfur compound included per 100 parts by weight of the base rubber be preferably at least 0.05 part by weight, and more preferably at least 0.1 part by weight, but preferably not more than 5 parts by weight, more preferably not more than 4 parts by weight, even more preferably not more than 3 parts by weight, and most preferably not more than 2.5 parts by weight. If too much organosulfur compound is included, the effects of addition may peak so that further addition has no apparent effect, whereas the use of too little organosulfur compound may fail to confer the effects of such addition to a sufficient degree.

Any suitable known method may be employed to form the above core. For example, the core-forming rubber composition may be masticated using an ordinary mixing apparatus (e.g., Banbury mixer, kneader, or roll mill), and the resulting compound may be molded under heat and compression in a core mold. Core formation may be carried out using as the vulcanization conditions for the core-forming rubber composition a vulcanization temperature of 100 to 200° C. and a vulcanization time of 10 to 40 minutes.

Next, the intermediate layer is described.

The intermediate layer has a thickness of preferably at least 1.0 mm but not more than 2.5 mm, and more preferably at least 1.2 mm but not more than 2.2 mm. If the intermediate layer is thinner than the above range, the golf ball may take on too much spin when hit with a W#1 or on full shots with an iron, as a result of which an increased distance may be achieved. Conversely, if the intermediate layer is thicker than the above range, the feel of the ball on impact may become too hard and a sufficient rebound may be impossible to achieve, as a result of which the ball may not travel a sufficient distance. The aforementioned intermediate layer thickness refers to the numerical range in the thickness of the entire intermediate layer, including not only cases in which it is composed of a single layer, but also cases in which it is composed of two or more layers.

The surface hardness of the intermediate layer is determined by the hardness and thickness of the intermediate layer and the hardness of the underlying material. The surface hardness of the intermediate layer may be measured by setting the durometer indenter in a substantially perpendicular manner on the intermediate layer surface which is a spherical surface, and carrying out measurement according to the JIS-C standard. Although not subject to any particular limitation, the surface hardness of the intermediate layer may be set to, in terms of the JIS-C standard, a hardness of preferably at least 80 but not more than 98, more preferably at least 85 but not more than 96, and even more preferably at least 90 but not more than 96. If the surface hardness is too much softer than the above-indicated hardness range, the spin rate on various types of shots may increase, possibly shortening the distance of travel. Moreover, the feel on impact may become too soft. Conversely, when the surface hardness is too much higher than the above hardness range, the spin rate may decrease, making the ball more difficult to control, the feel of the ball on impact may become too hard, and the durability of the ball to cracking on repeated impact may worsen. Moreover, it is desirable that the intermediate layer have a surface hardness which is higher than the surface hardness of the outer layer.

It is critical that the value A/B, where A is the deflection of a sphere composed of the core encased by the intermediate layer when compressed under a final load of 1,275 N (130 kg) from an initial load state of 98 N (10 kgf) and B is the deflection of the core when compressed under a final load of 1,275 N (130 kg) from an initial load state of 98 N (10 kgf), be at least 0.74 but not more than 0.82. This is substantially to optimize the balance between the hardness and the thickness of the intermediate layer. That is, the A/B value signifies that the intermediate layer has a certain degree of hardness and thickness. If the intermediate layer is too hard and too thick, the A/B value will be small. If the intermediate layer is too soft or hard but thin, the A/B value will be larger. At an A/B value smaller than the above range, the ball may have a poor controllability in the short game, too hard a feel on impact, and a poor durability. On the other hand, at an A/B value larger than the above range, the spin rate may increase, possibly resulting in a shorter distance of travel.

The deflection A by a sphere composed of the core encased by the intermediate layer, when compressed under a final load of 1,275 N (130 kg) from an initial load state of 98 N (10 kgf), is at least 2.3 mm but not more than 3.3 mm, preferably at least 2.5 mm but not more than 3.1 mm, and more preferably at least 2.6 mm but not more than 3.0 mm.

The intermediate layer material, while not subject to any particular limitation, is preferably composed primarily of an ionomer material. Specific examples include sodium-neutralized ionomer resins available under the trade name designations Himilan 1605, Himilan 1601 and Surlyn 8120, and zinc-neutralized ionomer resins such as Himilan 1557 and Himilan 1706. These may be used singly or as a combination of two or more thereof.

An embodiment in which the intermediate layer material is composed primarily of, in admixture, both a zinc-neutralized ionomer resin and a sodium-neutralized ionomer resin is especially preferable for attaining the objects of the invention. The mixing ratio, expressed as the weight ratio of zinc-neutralized resin to sodium-neutralized resin, is generally from 25/75 to 75/25, preferably from 35/65 to 65/35, and more preferably from 45/55 to 55/45.

Outside of this range, the ball rebound may be too low, as a result of which the desired distance may not be achieved, the durability to repeated impact at normal temperature may worsen, and the durability to cracking at low temperatures (below 0° C.) may worsen.

Various additives may be optionally included in the above-described intermediate layer material. For example, inorganic fillers such as zinc oxide, barium sulfate and titanium dioxide, pigments, dispersants, antioxidants, ultraviolet absorbers, and light stabilizers may be added.

To increase adhesion between the intermediate layer material and the urethane used in the subsequently described outermost layer cover, it is desirable to abrade the surface of the intermediate layer. In addition, it is preferable to apply a primer to the surface of the intermediate layer following such abrasion or to add an adhesion reinforcing agent to the intermediate layer material.

Next, the outermost layer cover is described.

The outermost layer cover has a thickness in a range of from 0.6 to 1.0 mm. If the outermost layer cover is thicker than the above range, the ball may have a poor rebound and too high a spin rate when hit with a W#1, as a result of which a sufficient distance may not be achieved. On the other hand, if the cover is too much thinner than the above range, the scuff resistance may worsen, resulting in a less than adequate controllability even for professionals and other skilled golfers.

The material used in the outermost layer cover is composed primarily of polyurethane so as to confer a good controllability and a good scuff resistance. For reasons having to do with controllability and scuff resistance, it is preferable to use a urethane cover as the outermost layer cover in the golf ball of the invention. The cover material formed of the above-described polyurethane composition has a sheet hardness (material hardness), expressed as the Durometer D hardness, of preferably from 40 to 60, more preferably from 43 to 57, and even more preferably from 46 to 54. If the cover material is too hard, the ball may lack spin receptivity on approach shots and thus have a less than satisfactory controllability even when played by a professional or other skilled golfer, or the ball may have a poor feel on impact, in addition to which the urethane material may have a poor rebound resilience and a poor durability. On the other hand, if the cover material is too soft, the spin rate of the ball when played with a driver may increase, reducing the distance traveled by the ball.

The surface hardness of the outermost layer cover is determined by the hardness and thickness of the outermost layer cover material and the hardness of the underlying material. The JIS-C hardness is preferably from 76 to 88, more preferably from 77 to 86, and even more preferably from 78 to 85. The surface hardness of the outermost layer cover corresponds to the surface hardness of the ball. If the outermost layer cover is softer than the above range, the ball may take on too much spin and thus fail to travel as far as desired. Conversely, if the outermost layer cover is harder than the above range, the ball may not be receptive to spin on approach shots, and may thus have insufficient controllability even when played by a professional golfer or a skilled amateur.

It is preferable for the outermost layer cover to be made softer than the surface hardness of the intermediate layer by a degree, expressed in JIS-C hardness units, of preferably from 2 to 20, more preferably from 4 to 19, and even more preferably from 6 to 18. If this difference is too small, the ball may not be receptive to spin on approach shots, and may thus have insufficient controllability even when played by a professional golfer or a skilled amateur. Conversely, if the difference is too large, the ball may have an inadequate rebound and may take on too much spin on full shots, as a result of which the desired distance may not be achieved.

A preferred example of the outermost layer cover in the invention is a resin composition of primarily (A) a thermoplastic polyurethane and (B) a polyisocyanate compound.

To fully exhibit the advantageous effects of the invention, a necessary and sufficient amount of unreacted isocyanate groups should be present in the cover resin material. Specifically, it is recommended that the total weight of above components A and B combined be at least 60%, and preferably at least 70%, of the overall weight of the cover layer. Components A and B are described in detail below.

The thermoplastic polyurethane serving as component A has a structure which includes soft segments made of a polymeric polyol that is a long-chain polyol (polymeric glycol), and hard segments made of a chain extender and a polyisocyanate compound. Here, the long-chain polyol used as a starting material-is not subject to any particular limitation, and may be any that is used in the prior art relating to thermoplastic polyurethanes. Exemplary long-chain polyols include polyester polyols, polyether polyols, polycarbonate polyols, polyester polycarbonate polyols, polyolefin polyols, conjugated diene polymer-based polyols, castor oil-based polyols, silicone-based polyols and vinyl polymer-based polyols. These long-chain polyols may be used singly or as combinations of two or more thereof. Of the long-chain polyols mentioned here, polyether polyols are preferred because they enable the synthesis of thermoplastic polyurethanes having a high rebound resilience and excellent low-temperature properties.

Illustrative examples of the above polyether polyol include poly(ethylene glycol), poly(propylene glycol), poly (tetramethylene glycol) and poly(methyltetramethylene glycol) obtained by the ring-opening polymerization of a cyclic ether. The polyether polyol may be used singly or as a combination of two or more thereof. Of these, poly(tetramethylene glycol) and/or poly(methyltetramethylene glycol) are preferred.

It is preferable for these long-chain polyols to have a number-average molecular weight in a range of 1,500 to 5,000. By using a long-chain polyol having a number-average molecular weight within this range, golf balls made of a thermoplastic polyurethane composition having excellent properties such as resilience and manufacturability can be reliably obtained. The number-average molecular weight of the long-chain polyol is more preferably in a range of 1,700 to 4,000, and even more preferably in a range of 1,900 to 3,000.

As used herein, "number-average molecular weight of the long-chain polyol" refers to the number-average molecular weight computed based on the hydroxyl number measured in accordance with JIS K-1557.

Suitable chain extenders include those used in the prior art relating to thermoplastic polyurethanes. For example, low-molecular-weight compounds which have a molecular weight of 400 or less and bear on the molecule two or more active hydrogen atoms capable of reacting with isocyanate groups are preferred. Illustrative, non-limiting, examples of the chain extender include 1,4-butylene glycol, 1,2-ethylene glycol, 1,3-butanediol, 1,6-hexanediol and 2,2-dimethyl-1,3-propanediol. Of these chain extenders, aliphatic diols having 2 to 12 carbons are preferred, and 1,4-butylene glycol is especially preferred.

The polyisocyanate compound is not subject to any particular limitation; preferred use may be made of one that is used in the prior art relating to thermoplastic polyurethanes. Specific examples include one or more selected from the group consisting of 4,4'-diphenylmethane diisocyanate, 2,4-toluene diisocyanate, 2,6-toluene diisocyanate, p-phenylene diisocyanate, xylylene diisocyanate, naphthylene-1,5-diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethylhexamethylene diisocyanate and dimer acid diisocyanate. Depending on the type of isocyanate used, the crosslinking reaction during injection molding may be difficult to control. In the practice of the invention, to provide a balance between stability at the time of production and the properties that are manifested, it is most preferable to use 4,4'-diphenylmethane diisocyanate, which is an aromatic diisocyanate.

It is most preferable for the thermoplastic polyurethane serving as above component A to be a thermoplastic polyurethane synthesized using a polyether polyol as the long-chain polyol, using an aliphatic diol as the chain extender, and using an aromatic diisocyanate as the polyisocyanate compound. It is desirable, though not essential, for the polyether polyol to be a polytetramethylene glycol having a number-average molecular weight of at least 1,900, for the chain extender to be 1,4-butylene glycol, and for the aromatic diisocyanate to be 4,4'-diphenylmethane diisocyanate.

The compounding ratio of activated hydrogen atoms to isocyanate groups in the above polyurethane-forming reaction can be controlled within a desirable range so as to make it possible to obtain a golf ball which is composed of a thermoplastic polyurethane composition and has various improved properties, such as rebound, spin performance, scuff resistance and manufacturability. Specifically, in preparing a thermoplastic polyurethane by reacting the above long-chain polyol, polyisocyanate compound and chain extender, it is desirable to use the respective components in proportions such that the amount of isocyanate groups on the polyisocyanate compound per mole of active hydrogen atoms on the long-chain polyol and the chain extender is from 0.95 to 1.05 moles.

No particular limitation is imposed on the method of preparing the thermoplastic polyurethane used as component A. Production may be carried out by either a prepolymer process or one-shot process in which a long-chain polyol, a chain extender and a polyisocyanate compound are used and a known urethane-forming reaction is effected. Of these, a process in which melt polymerization is carried out in a substantially solvent-free state is preferred. Production by continuous melt polymerization using a multiple screw extruder is especially preferred.

Illustrative examples of the thermoplastic polyurethane serving as component A include commercial products such as Pandex T8295, T8290, T8260, T8295 and T8290 (all available from DIC Bayer Polymer, Ltd.).

Next, in the single resin blend composed primarily of component A and component B, it is essential that, in at least a portion of the polyisocyanate compound used as component B, all the isocyanate groups on the molecule remain in an unreacted state. That is, polyisocyanate compound in which all the isocyanate groups on the molecule are in a completely free state should be present within the single resin composition, and such a polyisocyanate compound may be present together with polyisocyanate compound in which some of the isocyanate groups on the molecule are in a free state.

Various types of isocyanates may be employed without particular limitation as this polyisocyanate compound. Illustrative examples include one or more selected from the group consisting of 4,4'-diphenylmethane diisocyanate, 2,4-toluene diisocyanate, 2,6-toluene diisocyanate, p-phenylene diisocyanate, xylylene diisocyanate, naphthylene-1,5-diisocyanate, tetramethylxylene diisocyanate, hydrogenated xylylene diisocyanate, dicyclohexylmethane diisocyanate, tetramethylene diilsocyanate, hexamethylene diilsocyanate, isophorone diisocyanate, norbornene diisocyanate, trimethylhexamethylene diisocyanate and dimer acid diisocyanate. Of the above group of isocyanates, the use of 4,4'-diphenylmethane diisocyanate, dicyclohexylmethane diisocyanate and isophorone diisocyanate is preferable in terms of the balance between the influence on processability of such effects as the rise in viscosity that accompanies the reaction with the thermoplastic.polyurethane serving as component A and the physical properties of the resulting golf ball cover material.

In the practice of the invention, although not an essential constituent, a thermoplastic elastomer other than the above-described thermoplastic polyurethane may be included as component C together with components A and B. Incorporating this component C in the above resin composition enables the fluidity of the resin composition to be further improved and enables increases to be made in various properties required of golf ball cover materials, such as resilience and scuff resistance.

Component C, which is a thermoplastic elastomer other than the above thermoplastic polyurethane, is exemplified by one or more thermoplastic elastomer selected from the group consisting of polyester elastomers, polyamide elastomers, ionomer resins, styrene block elastomers, hydrogenated styrene-butadiene rubbers, styrene-ethylene/butylene-ethylene block copolymers and modified forms thereof, ethylene-ethylene/butylene-ethylene block copolymers and modified forms thereof, styrene-ethylene/butylene-styrene block copolymers and modified forms thereof, ABS resins, polyacetals, polyethylenes and nylon resins. The use of a polyester elastomer, a polyamide elastomer or a polyacetal is especially preferred for such reasons as enhancing the resilience and scuff resistance while retaining a good manufacturability.

The relative proportions of above components A, B and C are not subject to any particular limitation, although to fully achieve the advantageous effects of the invention, it is preferable for the weight ratio A:B:C of the respective components to be from 100:2:50 to 100:50:0, and more preferably from 100:2:50 to 100:30:8.

No particular limitation is imposed on the method for mixing together above components A to C in order to prepare the resin composition. However, it is preferable to select the mixing conditions such that, of the polyisocyanate compound, at least some polyisocyanate compound is present in which all the isocyanate groups on the molecule remain in an unreacted state. For example, it is desirable to furnish treatment such as mixing of the ingredients in an inert gas (e.g., nitrogen) or in a vacuum state. The resin composition is then injection-molded around a core which has been placed in a mold. To smoothly and easily handle the resin composition, it is preferable for the composition to be formed into pellets having a length of 1 to 10 mm and a diameter of 0.5 to 5 mm. Isocyanate groups in an unreacted state remain in these resin pellets; while the resin composition is being injection-molded about the core, or with post-treatment such as annealing, the unreacted isocyanate groups react with component A or component C to form a crosslinked material.

Various additives other than the ingredients making up the above-described thermoplastic polyurethane may be optionally included in the resin material of the outermost layer cover. Additives that may be suitably used include pigments, dispersants, antioxidants, light stabilizers, ultraviolet absorbers and parting agents.

When injection molding is carried out, it is desirable though not essential to carry out molding in a low-humidity environment, such as by purging with a low-temperature gas using an inert gas such as nitrogen or low dew-point dry air, or by vacuum treating, some or all places on the resin paths from the resin feed area to the mold interior. Preferred, non-limiting examples, of the medium used for transporting the resin include low-moisture gases such as low dew-point dry air or nitrogen gas. By carrying out molding in such a low-humidity environment, reaction by the isocyanate groups is kept from proceeding before the resin has been charged into the mold interior. As a result, polyisocyanate in which the isocyanate groups are present in an unreacted state is included to some degree in the resin molded part, thus making it possible to reduce variable factors such as unwanted rises in viscosity and enabling the effective crosslinking efficiency to be enhanced.

Techniques that could be used to confirm the presence of unreacted polyisocyanate compound within the resin composition prior to injection molding about the core include those which involve extraction with a suitable solvent that selectively dissolves out only the polyisocyanate compound. An example of a simple and convenient method is one in which confirmation is carried out by simultaneous thermogravimetric and differential thermal analysis (TG-DTA) measurement in an inert atmosphere. For example, when the resin composition (cover material) used in the invention is heated in a nitrogen atmosphere at a temperature ramp-up rate of 10° C./min, a gradual drop in the weight of diphenylmethane diisocyanate can be observed from about 150° C. On the other hand, in a resin sample in which the reaction between the thermoplastic polyurethane material and the isocyanate mixture has been carried out to completion, a weight drop from about 150° C. is not observed, but a weight drop from about 230 to 240° C. can be observed.

After the resin composition has been molded as described above, its properties as a golf ball cover can be further improved by carrying annealing so as to induce the crosslinking reaction to proceed further. "Annealing," as used herein, refers to aging the cover in a fixed environment for a fixed length of time.

The above method of molding the cover layer is exemplified by feeding the above resin composition to an injection molding machine, and injecting the molten resin composition around the core so as to form a cover layer. The molding temperature varies according to such factors as the type of thermoplastic polyurethane, but is typically in a range of 150 to 250° C.

Instead of the urethane resin composition made up of above components A to C, it is possible to use as a suitable material for the outermost layer cover in the invention a urethane resin material formed of a cover-molding material composed primarily of the following components E and F:

(E) a thermoplastic polyurethane material; and (F) an isocyanate mixture of (f-1) an isocyanate compound having two or more isocyanate groups as functional groups per molecule, dispersed in (f-2) a thermoplastic resin which is substantially non-reactive with isocyanate.

The foregoing polyurethane material E may be used within the range in the art described above for component A.

(F) Isocyanate Mixture

The isocyanate mixture (F) is prepared by dispersing (f-1) an isocyanate compound having as functional groups at least two isocyanate groups per molecule in (f-2) a thermoplastic resin which is substantially non-reactive with isocyanate. Above isocyanate compound (f-1) is preferably an isocyanate compound used in the prior art relating to thermoplastic polyurethane materials. Illustrative, non-limiting, examples include aromatic diisocyanates such as 4,4'-diphenylmethane diisocyanate, 2,4-toluene diisocyanate and 2,6-toluene diisocyanate; and aliphatic diisocyanates such as hexamethylene diisocyanate. From the standpoint of reactivity and work safety, the use of 4,4'-diphenylmethane diisocyanate is most preferred.

The thermoplastic resin (f-2) is preferably a resin having a low water absorption and excellent compatibility with thermoplastic polyurethane materials. Illustrative examples of such resins include polystyrene resins, polyvinyl chloride resins, ABS resins, polycarbonate resins and polyester elastomers (e.g., polyether-ester block copolymers, polyester-ester block copolymers). From the standpoint of rebound resilience and strength, the use of a polyester elastomer, particularly a polyether-ester block copolymer, is especially preferred.

In the isocyanate mixture (F), it is desirable for the relative proportions of the thermoplastic resin (f-2) and the isocyanate compound (f-1), expressed as the weight ratio (f-2):(f-1), to be from 100:5 to 100:100, and especially from 100:10 to 100:40. If the amount of the isocyanate compound (f-1) relative to the thermoplastic resin (f-2) is too small, a greater amount of the isocyanate mixture (F) will have to be added to achieve an amount of addition sufficient for the crosslinking reaction with the thermoplastic polyurethane material (E). As a result, the thermoplastic resin (f-2) will exert a large influence, compromising the physical properties of the cover-molding material. On the other hand, if the amount of the isocyanate compound (f-1) relative to the thermoplastic resin (f-2) is too large, the isocyanate compound (f-1) may cause slippage to occur during mixing, making preparation of the isocyanate mixture (F) difficult.

The isocyanate mixture (F) can be obtained by, for example, adding the isocyanate compound (f-1) to the thermoplastic resin (f-2) and thoroughly working together these components at a temperature of 130 to 250° C. using mixing rolls or a Banbury mixer, then either pelletizing or cooling and subsequently grinding. A commercial product such as Crossnate EM30 (produced by Dainichi Seika Colour & Chemicals Mfg. Co., Ltd.) may be suitably used as the isocyanate mixture (F).

Formation of the cover can be carried out by, for example, adding the isocyanate mixture (F) to the thermoplastic polyurethane material (E) and dry mixing, then using an injection molding machine to mold the mixture into a cover over the core. The molding temperature will vary with the type of thermoplastic polyurethane material (E), although molding is generally carried out within a temperature range of 150 to 250° C.

In the practice of the invention, by forming the outermost layer cover from the above-described cover-molding material, a golf ball having a better feel on impact, controllability, cutting resistance, scuff resistance and durability to cracking on repeated impact can be obtained.

As in methods for molding the cover of a conventional golf ball, any of various known methods, such as injection molding or compression molding, may be used to form the intermediate layer and the outermost layer cover described above. The intermediate layer and the outermost layer cover can easily be formed by suitably selecting conditions such as the injection temperature and time within the commonly used ranges.

In the (JIS-C surface hardness of intermediate layer× intermediate layer thickness)−(JIS-C surface hardness of cover×cover thickness) value according to the invention, "intermediate layer−cover" signifies a construction that is hard on the inside and soft on the outside, and includes as the elements therein not only the hardnesses but also the thicknesses of the respective layers. If the above value is below 90, the spin rate increases, as a result of which the ball may fail to travel as far as desired. On the other hand, at a value above 120, the ball has a poor controllability in the short game, an excessively hard feel, and a poor durability.

Numerous dimples may be formed on the outside surface of the above-described outermost layer cover. The number of dimples arranged on the outside surface of the outermost layer cover is preferably at least 280 but not more than 360, more preferably at least 300 but not more than 350, and even more preferably at least 320 but not more than 340. If the number of dimples is higher than the above range, the ball may have too low a trajectory and may thus fail to achieve the desired distance. Conversely, if the number of dimples is lower than the above range, the ball may assume a high trajectory, and may be readily subject to wind effects, making it more difficult to play golf.

The dimples may be of a circular shape or a non-circular shape, examples of the latter being various polygonal shapes, a dew drop shape, and other elliptical shapes. Any one or combination of two or more of these shapes may be suitably used. For example, if circular dimples are used, the diameter may be set to preferably at least 2.5 mm but not more than 6.5 mm, and the depth from a flat plane circumscribed by the edge of the dimple is preferably at least 0.08 mm but not more than 0.30 mm.

To optimize the trajectory of the ball, the value $V_0$ for each dimple, defined as the volume of space in a dimple below a flat plane circumscribed by the edge of the dimple, divided by the volume of a cylinder whose base is the flat plane and whose height is the maximum depth of the dimple from the base, may be set in a range of preferably 0.35 to 0.80.

To take full advantage of their aerodynamic properties, it is preferable for the dimples to have a coverage on the spherical surface of the golf ball, expressed as the sum of the individual dimple surface areas defined by the border of the flat plane circumscribed by the edge of the dimple as a proportion SR of the spherical surface area of the ball were it to have no dimples thereon, of generally at least 60% but not more than 90%.

Moreover, the VR value, which is the sum of the dimple volumes below the flat plane circumscribed by the edge of each respective dimple, expressed as a percentage of the volume of golf ball sphere were it to have no dimples thereon, can be set to generally from 0.6 to 1. Outside of this range, a good trajectory cannot be obtained.

The golf ball of the invention is preferably formed to a diameter of not less than 42.67 mm, and preferably from 42.67 to 42.75 mm, and to a weight of preferably from 45.0 to 45.9 g.

As explained above, the golf ball of the invention has a greatly improved flight, a substantially improved controllability, and excellent durability to cracking on repeated impact and excellent scuffing resistance, thus endowing it with a performance that is ideal for professional golfers and skilled amateurs.

EXAMPLES

Examples of the invention and Comparative Examples are given below by way of illustration, and not by way of limitation.

Examples 1 and 7, Comparative Examples 1 to 6

Rubber materials formulated as shown in Table 1 below were prepared for the production of the golf balls in Examples 1 to 7 according to the invention and Comparative Examples 1 to 6. Each of these rubber compositions was suitably masticated with a kneader or roll mill, then vulcanized at 157° C. for 15 minutes to form solid cores. Numbers shown for each material in the table below indicate parts by weight.

TABLE 1

| | parts by weight | | | | | | |
|---|---|---|---|---|---|---|---|
| | A | B | C | D | E | F | G |
| Butadiene rubber[1)] | 100 | 100 | 100 | 100 | 100 | 100 | 100 |
| Sulfur | 0.1 | 0.1 | 0.1 | 0.1 | 0.1 | 0.1 | 0.1 |
| Zinc acrylate | 40.0 | 37.5 | 35.0 | 37.5 | 37.5 | 32.0 | 35.0 |
| Peroxide[2)] | 3 | 3 | 3 | 3 | 3 | 3 | 3 |
| Zinc oxide | 19.2 | 20.19 | 21.18 | 22.36 | 16.57 | 22.36 | 26.03 |
| Zinc salt of pentachlorothiophenol | 1.5 | 1.5 | 1.5 | 1.5 | 1.5 | 1.5 | 1.5 |
| Zinc stearate | 5 | 5 | 5 | 5 | 5 | 5 | 5 |

[1)]Polybutadiene: JSR BR730

[2)]Peroxide: Dicumyl peroxide, produced by NOF Corporation under the trade name Percumyl D.

Next, intermediate layer (1) or (2) shown in Table 2 was injection-molded over the solid core in the respective examples according to the invention and the comparative examples, following which cover materials (3) to (6) shown in the same table were injection-molded onto the surface of the intermediate layer, giving three-piece golf balls. Cover materials (3) to (6) were obtained by mixing the starting materials shown in Table 2 (unit: parts by weight) using a twin-screw extruder in a nitrogen gas atmosphere so as to form a cover resin blend in the form of pellets having a length of 3 mm and a diameter of 1 to 2 mm, then vacuum drying the material paths at the time of injection molding.

TABLE 2

| | (1) | (2) | (3) | (4) | (5) | (6) |
|---|---|---|---|---|---|---|
| Himilan 1605 | 50 | 68.8 | | | | |
| Himilan 1706 | 35 | | | | | |
| Himilan 1557 | 15 | | | | | |
| Dynaron 6100P | | 31.2 | | | | |
| Behenic acid | | 18.0 | | | | |
| Calcium hydroxide | | 2.3 | | | | |
| Trimethylolpropane | 1.0 | 1.0 | | | | |
| Thermoplastic polyurethane 1 | | | 100 | | | |
| Thermoplastic polyurethane 2 | | | | 100 | | |
| Thermoplastic polyurethane 3 | | | | | 100 | |
| Thermoplastic polyurethane 4 | | | | | | 100 |
| Polyisocyanate compound | | | 9 | 9 | 9 | 9 |
| Thermoplastic elastomer | | | 15 | 15 | 15 | 15 |
| Titanium oxide | | | 3.5 | 3.5 | 3.5 | 3.5 |
| Polyethylene wax | | | 1.5 | 1.5 | 1.5 | 1.5 |

*Note:
Numbers for the respective components indicate parts by weight.

Details concerning the above trade names are given below.

Himilan 1605, Himilan 1557, Himilan 1706: Ionomer resins produced by DuPont-Mitsui Polychemicals Co., Ltd.

Dynaron 6100P: A block copolymer which is a butadiene-styrene copolymer hydrogenate (produced by JSR Corporation).

Behenic acid: NAA222-S (beads), produced by NOF Corporation.

Calcium hydroxide: CLS-B, produced by Shiraishi Kogyo.

Polyisocyanate compound: 4,4'-diphenylmethane diisocyanate

Thermoplastic elastomer: The thermoplastic polyether-ester elastomer Hytrel 4001 (produced by DuPont-Toray Co., Ltd.) was used.

Polyethylene wax: Sanwax 161P (produced by Sanyo Chemical Industries, Ltd.)

Thermoplastic polyurethane 1: Pandex T8295 and Pandex T8290 were used in a weight ratio of 25/75. Both were products of DIC-Bayer Polymer, Ltd.

Thermoplastic polyurethane 2: Pandex T8295 (produced by DIC-Bayer Polymer, Ltd.), an MDI-PTMG type thermoplastic polyurethane having a JIS-A hardness of 97 and a rebound resilience of 44%.

Thermoplastic polyurethane 3: Pandex T8290 (produced by DIC-Bayer Polymer, Ltd.), an MDI-PTMG type thermoplastic polyurethane having a JIS-A hardness of 93 and a rebound resilience of 52%.

Thermoplastic polyurethane 4: Pandex T8260 and Pandex T8295 were used in a weight ratio of 50/50. Both are products of DIC-Bayer Polymer, Ltd. Pandex T8260 is an MDI-PTMG type thermoplastic polyurethane having a Durometer D hardness of 56 and a rebound resilience of 46%.

Tables 3 and 4 show the properties of the golf balls obtained in the respective examples of the invention and the comparative examples, as well as test results for flight, feel and durability.

TABLE 3

| | | | Example | | | | | | |
|---|---|---|---|---|---|---|---|---|---|
| | | | 1 | 2 | 3 | 4 | 5 | 6 | 7 |
| Core | Diameter (mm) | | 37.6 | 37.6 | 37.6 | 37.6 | 36.6 | 37.8 | 37.8 |
| | Formulation | | A | B | C | B | D | B | B |
| | Deflection (mm) | | 3.2 | 3.45 | 3.7 | 3.45 | 3.45 | 3.45 | 3.45 |
| | Core center hardness (JIS-C) | | 59 | 58 | 57 | 58 | 58 | 58 | 58 |
| | Core surface hardness (JIS-C) | | 85 | 84 | 83 | 84 | 84 | 84 | 84 |
| | Core hardness difference (surface − center)(JIS-C) | | 26 | 26 | 26 | 26 | 26 | 26 | 26 |
| Intermediate layer | Formulation | | (1) | (1) | (1) | (1) | (1) | (1) | (1) |
| | Surface hardness (JIS-C) | | 95 | 95 | 95 | 95 | 95 | 95 | 95 |
| | Thickness (mm) | | 1.73 | 1.73 | 1.73 | 1.73 | 2.08 | 1.78 | 1.78 |
| | Diameter of sphere composed of core encased by intermediate layer (mm) | | 41.05 | 41.05 | 41.05 | 41.05 | 40.75 | 41.35 | 41.35 |
| | Deflection of above sphere (mm) | | 2.5 | 2.73 | 2.95 | 2.73 | 2.6 | 2.7 | 2.7 |
| Ball | Outermost layer cover formulation | | (3) | (3) | (3) | (4) | (3) | (3) | (5) |
| | Outermost layer surface hardness (JIS-C) | | 81 | 81 | 81 | 87 | 81 | 81 | 78 |
| | Outermost layer thickness (mm) | | 0.83 | 0.83 | 0.83 | 0.83 | 0.98 | 0.68 | 0.68 |
| | Diameter (mm) | | 42.7 | 42.7 | 42.7 | 42.7 | 42.7 | 42.7 | 42.7 |
| | Weight (g) | | 45.5 | 45.5 | 45.5 | 45.5 | 45.5 | 45.5 | 45.5 |
| Formula I | Deflection ratio: intermediate layer/core | | 0.78 | 0.79 | 0.8 | 0.79 | 0.75 | 0.78 | 0.78 |
| Formula II | (Intermediate layer surface hardness (JIS-C) × intermediate layer thickness) − (cover surface hardness (JIS-C) × cover thickness) | | 97 | 97 | 97 | 92.1 | 118.2 | 114 | 116 |
| Flight | W#1 | Carry (m) | 241 | 239.7 | 238.2 | 239.8 | 240.6 | 239.1 | 239.3 |
| | HS, | Total distance (m) | 257.8 | 256.5 | 255.3 | 257.5 | 256.9 | 256.7 | 255.6 |
| | 50 m/s | Spin rate (rpm) | 2600 | 2510 | 2410 | 2420 | 2590 | 2450 | 2530 |
| | | Travel distance (rating) | good | good | good | good | good | good | good |

TABLE 3-continued

| | | | Example | | | | | | |
|---|---|---|---|---|---|---|---|---|---|
| | | | 1 | 2 | 3 | 4 | 5 | 6 | 7 |
| Spin on approach shots | SW HS, 16 m/s | Spin rate (rpm) | 6290 | 6210 | 6130 | 6020 | 6250 | 6150 | 6260 |
| | | Rating | good | good | good | good | good | good | good |
| Feel | W#1 (rating) | | good | good | good | good | good | good | good |
| | Putter (rating) | | good | good | good | good | good | good | good |
| Durability | Durability to repeated impact (rating) | | good | good | good | good | good | good | good |
| | Scuff resistance (rating) | | good | good | good | good | good | good | good |

TABLE 4

| | | | Comparative Example | | | | | |
|---|---|---|---|---|---|---|---|---|
| | | | 1 | 2 | 3 | 4 | 5 | 6 |
| Core | Diameter (mm) | | 38.8 | 37.6 | 37.8 | 37.6 | 37.6 | 36.1 |
| | Formulation | | E | B | B | B | F | G |
| | Deflection (mm) | | 3.45 | 3.45 | 3.45 | 3.45 | 4.1 | 3.7 |
| | Core center hardness (JIS-C) | | 58 | 58 | 58 | 58 | 56 | 57 |
| | Core surface hardness (JIS-C) | | 84 | 84 | 84 | 84 | 81 | 83 |
| | Core hardness difference (surface − center)(JIS-C) | | 26 | 26 | 26 | 26 | 25 | 26 |
| Intermediate layer | Formulation | | (1) | (1) | (1) | (2) | (1) | (1) |
| | Surface hardness (JIS-C) | | 95 | 95 | 95 | 88 | 95 | 95 |
| | Thickness (mm) | | 1.13 | 1.73 | 1.93 | 1.73 | 1.73 | 2.48 |
| | Diameter of sphere composed of core encased by intermediate layer (mm) | | 41.05 | 41.05 | 41.65 | 41.05 | 41.05 | 41.05 |
| | Deflection of above sphere (mm) | | 2.9 | 2.73 | 2.7 | 2.93 | 3.2 | 2.7 |
| Ball | Outermost layer cover formulation | | (3) | (6) | (4) | (3) | (3) | (3) |
| | Outermost layer surface hardness (JIS-C) | | 81 | 90 | 87 | 81 | 81 | 81 |
| | Outermost layer thickness (mm) | | 0.83 | 0.83 | 0.53 | 0.83 | 0.83 | 0.83 |
| | Diameter (mm) | | 42.7 | 42.7 | 42.7 | 42.7 | 42.7 | 42.7 |
| | Weight (g) | | 45.5 | 45.5 | 45.4 | 45.5 | 45.5 | 45.5 |
| Formula I | Deflection ratio: intermediate layer/core | | 0.84 | 0.79 | 0.78 | 0.85 | 0.78 | 0.73 |
| Formula II | (Intermediate layer surface hardness (JIS-C) × intermediate layer thickness) − (cover surface hardness (JIS-C) × cover thickness) | | 40 | 89.6 | 137.2 | 85 | 97 | 168.3 |
| Flight | W#1 | Carry (m) | 238 | 239.5 | 240.1 | 237.1 | 236.6 | 240.7 |
| | HS, 50 m/s | Total distance (m) | 254.7 | 258 | 257.9 | 253.9 | 253.1 | 257.2 |
| | | Spin rate (rpm) | 2460 | 2370 | 2400 | 2550 | 2350 | 2620 |
| | | Travel distance (rating) | NG | good | good | NG | NG | good |
| Spin on approach shots | SW HS, 16 m/s | Spin rate (rpm) | 6150 | 5820 | 5920 | 6220 | 6050 | 6270 |
| | | Rating | good | NG | NG | good | good | good |
| Feel | W#1 (rating) | | good | good | good | good | NG | good |
| | Putter (rating) | | good | NG | NG | good | good | NG |
| Durability | Durability to repeated impact (rating) | | good | good | good | good | good | good |
| | Scuff resistance (rating) | | good | NG | NG | good | good | good |

Deflection (1) Deformation (mm) by the core when compressed from an initial load state of 98 N (10 kgf) to a final load of 1,275 N (130 kgf) was measured.

(2) Deformation (mm) by the sphere composed of the core encased by the intermediate layer when compressed from an initial load state of 98 N (10 kgf) to a final load of 1,275 N (130 kgf) was measured.

JIS-C Hardness at Core Surface and Core Center

For the core surface, the durometer was set perpendicular to a surface portion of the spherical core and the hardness was measured in accordance with the JIS-C hardness standard. The results are indicated as JIS-C hardness values.

For the center of the core, the core was cut into hemispheres and the cut face was prepared as a flat plane, following which the durometer indenter was pressed perpendicularly against the center portion of the cut face and measurement was carried out. The results are indicated as JIS-C hardness values.

Surface Hardness (JIS-C Hardness) of Intermediate Layer-Covered Sphere

The durometer indenter was set substantially perpendicular to the spherical intermediate layer surface, and measurement was carried out in accordance with the JIS-C hardness standard.

Surface Hardness (JIS-C Hardness) of Cover

The durometer indenter was set substantially perpendicular to a dimple-free area of the surface (cover surface) of the ball composed of the above-described sphere encased by the cover, and measurement was carried out in accordance with the JIS-C hardness standard.

Flight

A TourStage X-Drive Type 405 (loft angle, 9.5°) manufactured by Bridgestone Sports Co., Ltd. was mounted as the driver (W#1) on a swing robot, and the distance traveled by the ball when hit at a head speed (HS) of 50 m/s was measured. The results were rated according to the following criteria.

Good: Total distance was 255 m or more

NG: Total distance was less than 255 m

Spin on Approach Shots

The spin rate on approach shots taken with a sand wedge (SW) at a head speed of 16 m/s were rated according to the following criteria.

Good: 6,000 rpm or more

NG: less than 6,000 rpm

Feel

Each ball was hit by three top amateur golfers, and sensory evaluated based on the following criteria.

Good: Good feel

NG: Too hard or too soft

Durability on Repeated Impact

A TourStage X-Drive Type 405 (loft angle, 9.5°) manufactured by Bridgestone Sports Co., Ltd. was mounted as the driver (W#1) on a swing robot, and repeatedly hit at a head speed of 50 m/s. The durability was rated based on the number of times the ball had been hit when its rebound was repeatedly 3% below the initial value.

Good: 80 or more time

NG: Less than 80 times

Scuff Resistance

A pitching sand wedge (PW) was set in a swing robot, and the ball was hit once at a head speed of 35 m/s, following which the surface state of the ball was visually examined and rated as follows.

Good: Can be used again

NG: Cannot be used again

In Comparative Example 1, the core diameter was large and the formula I value was large, as a result of which the distance traveled by the ball when hit with a driver (W#1) was poor. In Comparative Example 2, the outermost layer had a high surface hardness and the formula II value was small, as a result of which the ball had a poor controllability when hit with a sand wedge (SW) and a poor scuff resistance. In Comparative Example 3, the cover had a small thickness and a large formula II value, resulting in a poor controllability when played with a sand wedge and a poor scuff resistance. In Comparative Example 4, the formula II value was small, and the ball traveled an insufficient distance when hit with a W#1. In Comparative Example 5, the core was soft, resulting in a short distance of travel when the ball was hit with a W#1, in addition to which the feel of the ball when hit with a W#1 was too soft. In Comparative Example 6, the core diameter was small, as a result of which the formula I and II values fell outside of the indicated ranges, and the ball had a poor feel when hit with a putter.

The invention claimed is:

1. A golf ball comprising a solid core, an intermediate layer encasing the core, and an outermost layer cover of urethane which is softer than the intermediate layer, wherein the outermost layer cover has a surface hardness, expressed in JIS-C hardness units, of at least 76 but not more than 88 and a thickness of at least 0.6 mm but not more than 1.0 mm; letting A be the deflection of a sphere composed of the core encased by the intermediate layer when compressed under a final load of 1,275 N (130 kg) from an initial load state of 98 N (10 kgf) and B be the deflection of the core when compressed under a final load of 1,275 N (130 kg) from an initial load state of 98 N (10 kgf), the value A/B is at least 0.74 but not more than 0.82; and the value expressed as (JIS-C surface hardness of intermediate layer×intermediate layer thickness)−(JIS-C surface hardness of cover×cover thickness) is at least 90 but not more than 120.

2. The golf ball of claim 1, wherein the solid core has a diameter of from 36.3 to 37.9 mm, the core has a deflection B when compressed under a final load of 1,275 N (130 kg) from an initial load state of 98 N (10 kgf) of from 3.0 to 3.8 mm, and the hardness difference between the surface and the center of the core, expressed in JIS-C hardness units, is more than 20.

3. The golf ball of claim 1, wherein the outermost layer cover is formed by injection molding a single resin blend composed primarily of (A) a thermoplastic polyurethane and (B) a polyisocyanate compound, which resin blend contains a polyisocyanate compound in at least a portion of which all the isocyanate groups on the molecule remain in an unreacted state.

4. The golf ball of claim 3, wherein the resin blend additionally includes (C) a thermoplastic elastomer other than a thermoplastic polyurethane.

* * * * *